US011589642B1

(12) United States Patent
Deiana

(10) Patent No.: US 11,589,642 B1
(45) Date of Patent: Feb. 28, 2023

(54) VENTILATED SHOES

(71) Applicant: Salvatore Deiana, Vancouver (CA)

(72) Inventor: Salvatore Deiana, Vancouver (CA)

( * ) Notice: Subject to any disclaimer, the term of this patent is extended or adjusted under 35 U.S.C. 154(b) by 0 days.

(21) Appl. No.: 17/878,754

(22) Filed: Aug. 1, 2022

Related U.S. Application Data

(60) Provisional application No. 63/261,268, filed on Sep. 16, 2021.

(51) Int. Cl.
*A43B 7/06* (2006.01)

(52) U.S. Cl.
CPC ..... *A43B 7/06* (2013.01)

(58) Field of Classification Search
CPC ..... A43B 7/083; A43B 7/06
USPC ..... 36/3 B
See application file for complete search history.

(56) References Cited

U.S. PATENT DOCUMENTS 3,050,875 A * 8/1962 Robbins ..... A43B 7/06 36/3 B
4,063,371 A * 12/1977 Batra ..... A43B 7/06 36/3 B
6,044,577 A * 4/2000 Clark ..... A43B 7/081 36/29
6,085,444 A * 7/2000 Cho ..... A43B 7/06 36/3 R
8,893,403 B2 * 11/2014 Mohlmann ..... A43B 7/06 36/3 R
11,357,283 B2 * 6/2022 Jang ..... A43B 7/084
2003/0145486 A1 * 8/2003 Cardarelli ..... A43B 23/24 36/3 R
2005/0005473 A1 * 1/2005 Oh ..... A43B 7/081 36/3 R
2020/0046071 A1 * 2/2020 Henrichot ..... A43B 3/34

* cited by examiner

*Primary Examiner* — Timothy K Trieu
(74) *Attorney, Agent, or Firm* — Donald R. Boys; Central Coast Patent Agency LLC

(57) ABSTRACT

A ventilation apparatus for an article of footwear has a hollow air pump chamber, one or more one-way air valves positioned through the top wall of the air pump chamber, and an air intake channel with a one-way valve coupled through an opening into the air pump chamber. Action of stepping down on the air pump chamber deforms the walls and increases pressure in the air pump chamber, and forces air out of the air pump chamber through the one or more one-way air valves positioned through the top wall of the air pump chamber, and action of lifting weight off the air pump chamber causes the deformed walls to return toward original form, decreasing pressure in the air pump chamber and drawing air in through the air intake channel.

17 Claims, 4 Drawing Sheets

VENTILATED SHOES

CROSS-REFERENCE TO RELATED APPLICATIONS

The present case claims priority to provisional patent application 63/261,268, filed Sep. 16, 2021. All disclosure of the parent case is incorporated at least by reference.

BACKGROUND OF THE INVENTION

1. Field of the Invention

The present invention is in the technical field of footwear and pertains more particularly to articles of footwear such as ventilated shoes, boots and other footwear.

2. Description of Related Art

The general construction of footwear is well known in the art. A typical boot or shoe has a sole, a toe and a heel and a foot enclosure. The foot enclosure has in most instances a mechanism for opening the enclosure to enable placing a foot in the enclosure. This mechanism is in some circumstances an opening on a topside of the enclosure, in the heel to toe direction. In some case the opening has an elastic closure that may stretch to allow a user to insert a foot into the boot or shoe, and once donned, the elastic closure holds the boot or shoe on the user's foot. In other circumstance there may be a tongue proceeding upward from a forward part of the opening, and there be eyelets for laces that may be relaxed for donning the boot or shoe and laced and tied to retain.

Ventilated shoes are not entirely unknown in the art. Many casual and athletic shoes are manufactured of porous fabric and other porous material, such that some air circulation is natural. Still, there is typically no positive means for circulating air from outside into a shoe or boot, around a user's feet and outside the shoe again.

Poor or non-existent air circulation for a boot or shoe leads to foot odor and in many cases bacterial accumulation. What is clearly needed is a mechanism integrated with footwear that positively moves air from outside the footwear, through the footwear around a user's feet and out again.

BRIEF SUMMARY OF THE INVENTION

In one embodiment of the present invention a ventilation apparatus for an article of footwear is provided, comprising a hollow air pump chamber having flexible top, bottom and side walls, one or more one-way air valves positioned through the top wall of the air pump chamber, allowing air flow out of the air pump chamber but not into the air pump chamber, and an air intake channel coupled through an opening into the air pump chamber, the air intake channel having a one-way air valve allowing air to flow into the air pump chamber but not out of the air pump chamber. Action of stepping down on the air pump chamber deforms the walls of the air pump chamber in a manner to decrease volume and increase pressure in the air pump chamber, and forces air out of the air pump chamber through the one or more one-way air valves positioned through the top wall of the air pump chamber, and action of lifting weight off the air pump chamber causes the deformed walls to return toward original form, decreasing pressure in the air pump chamber and drawing air in through the air intake channel.

In one embodiment the air pump chamber has a horizontal shape of an inside of an article of footwear and height substantially less than any horizontal dimension. Also, in one embodiment the height is equal or less than one-half inch. In one embodiment the ventilation apparatus further comprises an air diffusion layer overlying the air pump chamber, the air diffusion layer comprising open-cell material and receiving air from the air pump chamber through the one or more one-way air valves in the top of the air pump chamber. In one embodiment the air diffusion layer has the shape of the top of the air pump chamber, but is of lesser extent, and has a height substantially less than any horizontal dimension. And in one embodiment the air diffusion chamber is joined by adhesive to the top of the air pump chamber.

In another aspect of the invention an article of footwear is provided, comprising a sole portion, an upper portion adapted to retain a user's foot, an opening in the upper portion adapted to enable the user to insert the foot, and a ventilation apparatus adapted to be inserted into the article of footwear. The ventilation apparatus comprises a hollow air pump chamber having flexible top, bottom and side walls, one or more one-way air valves positioned through the top wall of the air pump chamber, allowing air flow out of the air pump chamber but not into the air pump chamber, and an air intake channel coupled through an opening into the air pump chamber, the air intake channel having a one-way air valve allowing air to flow into the air pump chamber but not out of the air pump chamber. Action of stepping down on the ventilation apparatus deforms the walls of the air pump chamber in a manner to decrease volume and increase pressure in the air pump chamber, and forces air out of the air pump chamber through the one or more one-way air valves positioned through the top wall of the air pump chamber, and action of lifting weight off the ventilation apparatus causes the deformed walls to return toward original form, decreasing pressure in the air pump chamber and drawing air in through the air intake channel.

In one embodiment the air pump chamber has a horizontal shape of an inside of an article of footwear and height substantially less than any horizontal dimension. Also, in one embodiment the height is equal or less than one-half inch. Also, in one embodiment the article of footwear of claim 7 further comprises an air diffusion layer overlying the air pump chamber, the air diffusion layer comprising open-cell material and receiving air from the air pump chamber through the one or more one-way air valves in the top of the air pump chamber. Also, in one embodiment the air diffusion layer has the shape of the top of the air pump chamber, but is of lesser extent, and has a height substantially less than any horizontal dimension. Also, in one embodiment the air diffusion chamber is joined by adhesive to the top of the air pump chamber.

In one embodiment of the article of footwear the ventilation apparatus is a standalone apparatus insertable into and removable from the article of footwear. In another embodiment of the article of footwear the ventilation apparatus is built into the article of footwear.

In yet another aspect of the invention a a method for ventilating an article of footwear is provided, comprising implementing a ventilation apparatus in the article of footwear, stepping down on a hollow air pump chamber having a flexible top, bottom and side walls in the article of footwear, deforming the walls of the air pump chamber in a manner to decrease volume and increase pressure in the air pump chamber, forcing air out of the air pump chamber through one or more one-way air valves positioned through the top wall of the air pump chamber, and lifting weight off the air pump chamber causing the deformed walls to return toward original form, decreasing pressure in the air pump chamber and drawing air in through an air intake channel having a one-way air valve allowing air into the air pump chamber but not allowing air to flow out of the air pump chamber.

In one embodiment of the method the air pump chamber has a horizontal shape of an inside of an article of footwear and height substantially less than any horizontal dimension, comprising stepping down on and lifting weight off the air pump chamber. Also, in one embodiment the height is equal or less than one-half inch, and the act of stepping down is done over a height of less than one-half inch. In one embodiment the method further comprises an air diffusion layer overlying the air pump chamber, the air diffusion layer comprising open-cell material and receiving air from the air pump chamber through the one or more one-way air valves in the top of the air pump chamber, comprising pumping air into the air diffusion layer. In one embodiment the air diffusion layer has the shape of the top of the air pump chamber, but is of lesser extent, and has a height substantially less than any horizontal dimension, comprising pumping air into the air diffusion layer. And in one embodiment of the method the air diffusion chamber is joined by adhesive to the top of the air pump chamber, comprising pumping air into the air diffusion layer.

DETAILED DESCRIPTION OF THE INVENTION

Figure 1:
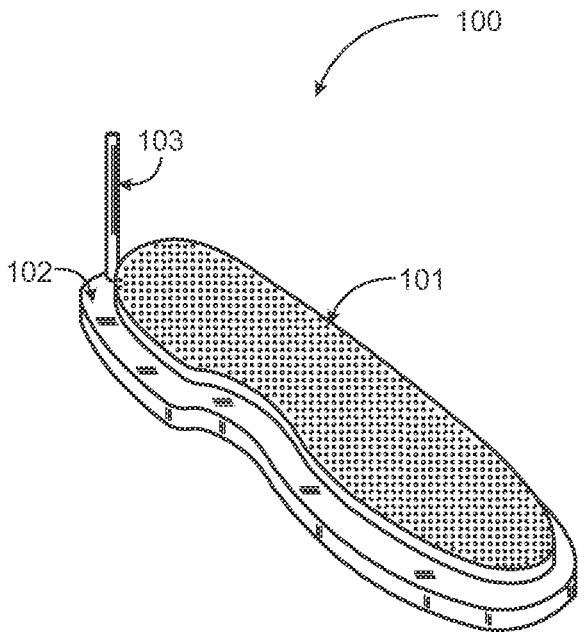
FIG. 1 is a perspective view of a shoe ventilation apparatus in an embodiment of the invention.

FIG. 1 is a perspective view of a shoe ventilation apparatus 100 in an embodiment of the invention. Apparatus 100 comprises an exhaust diffusion layer 101, an air pump chamber 102 and an air intake channel 103. Air pump chamber 102 is adapted to draw in air from outside through a valved input channel 103, and to provide the indrawn air through other one-way valves not shown in FIG. 1 to exhaust diffusion layer 101. Internal details of the air pump chamber, the air intake channel and the exhaust diffusion layer are provided below referencing other figures. Shoe ventilation apparatus 100 in one embodiment is a stand-alone apparatus that may be inserted into or withdrawn from a boot or shoe, much as might be done with an insole, or may be built into a boot or shoe and not easily removable. The relative thickness of the air pump chamber and of the exhaust diffusion layer is greater in FIG. 1 than it may be in practice. The thickness of each element may differ considerably in different embodiments. The outer shape of the apparatus in a horizontal plane in this example is for a user's left foot. An apparatus for the right foot would be a left-right mirror image of the apparatus illustrated.

Figure 2:
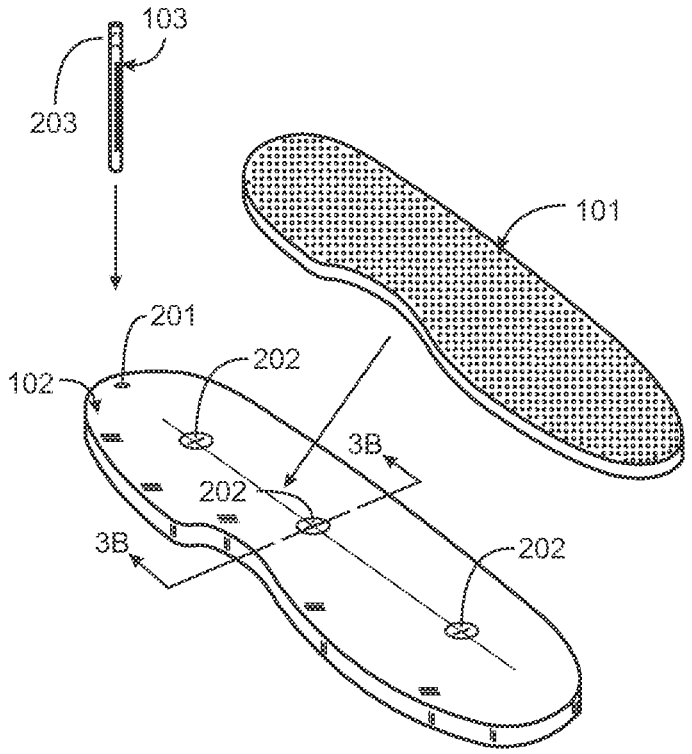
FIG. 2 is an exploded view of the elements of the apparatus of FIG. 1 in an embodiment of the invention.

FIG. 2 is an exploded view of the elements of the apparatus of FIG. 1 in an embodiment of the invention. Air intake channel 103 engages air pump chamber 102 by opening 201 and has a one-way valve 203 implemented in the channel that allows air from outside into air pump chamber 102, but blocks air from being expelled upward through the air intake channel. Air pump chamber 102 has a horizontal shape of the inside of a boot or shoe and an overall height substantially less than any horizontal dimension. In most embodiments the height may be equal to or less than one-half inch. In this example, three one-way valves 202 are implemented through a top wall of the air pump chamber, that allow air to pass from the air pump chamber into exhaust diffusion layer 101, but blocks air from entering the air pump chamber through any one of the one-way valves 202.

Air input channel 103 may be secured in opening 201 by adhesive and exhaust diffusion layer 101 may be secured to air pump chamber 102 also by adhesive. Exhaust diffusion layer 101 in this example may be an open-cell porous and flexible material such that it may serve as a cushion and may pass air from the air pump chamber into the inside of a boot or shoe withing which the apparatus 100 may be inserted.

Figure 3A:
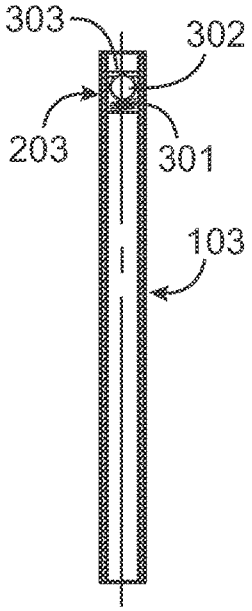
FIG. 3A is a section view of air intake channel 103 and one-way valve 203 taken along a central axis of the air intake channel in an embodiment of the invention.

FIG. 3A is a section view of air intake channel 103 and one-way valve 203 taken along a central axis of the air intake channel. One-way valve 203 may be implemented near an upper end of the channel but may be implemented at any position in the channel. In this example one-way valve 203 is a ball valve comprising a ball 302 held by a spring 301 against a seat 303. A partial vacuum created in the channel by action of air pump chamber 102 causes the ball to be drawn away from seat 303 and air to pass into and through the channel, into air pump chamber 102. The ball valve is just one of different implementations of one-way valves, and other versions may be used instead, such a slit vale or a flap valve.

Figure 3B:
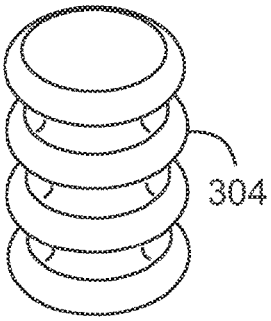
FIG. 3B is a perspective view of an air cushion element 304 in an embodiment of the invention.
Figure 3C:
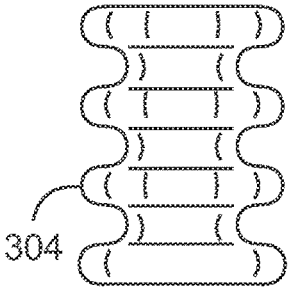
FIG. 3C is a side elevation view of the air cushion element of FIG. 3B in an embodiment of the invention.
Figure 3D:
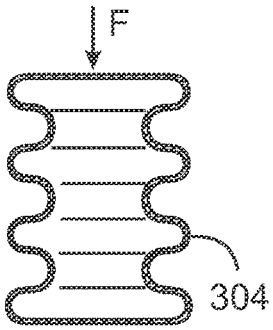
FIG. 3D is a section view of the air cushion element of FIG. 3C in an embodiment of the invention.

FIG. 3B is a perspective view of an air cushion element 304 used in embodiments of the invention. FIG. 3C is a side elevation view of element 304, and FIG. 3D is a section view of air cushion element 304. Element 304 is a cushion molded from rubber or rubberlike material such as imitation rubber or any one of several polymer compounds that behave like rubber. As seen in FIGS. 3B and 3C there are in this example four wider sections interspaced with four narrower sections, and the element has a relatively thin wall. The element is closed at both ends and has air inside at atmospheric pressure or higher. A force F applied downward on element 304 with the lower base held stationary will cause element 304 to deform downward to a lesser height, but the air inside, being compressed in the action, will exert an increasing force upward, as may be true with a spring. If force F is released element 304 will return to its original height without force F. The geometry and wall thickness may differ in different embodiments such the element will exhibit a different spring constant providing a different varying force in compression.

Figure 3E:
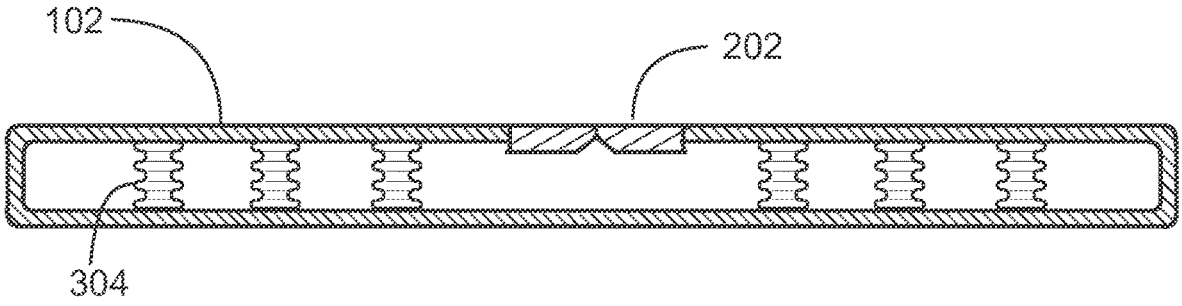
FIG. 3E is a section view across an air pump chamber of the apparatus of FIG. 1 in an embodiment of the invention.

FIG. 3E is a cross section view of air pump chamber 102 taken along section line 3B-3B in FIG. 2. The walls of air pump chamber 102 are flexible and elastic, and there are I this example a plurality of air cushion elements 304 implemented within the walls of air pump chamber 102, such that the action of a user taking a step places the user's weight on the air diffusion layer and hence on the air pump chamber, which is forced to collapse to some extent, compressing as well the air cushion elements, which decrease the internal volume of the air pump chamber and increases the air pressure in the air pump chamber, forcing air through slit valves 202 into air diffusion layer 101. The act of walking or running repeatedly in a boot or shoe comprising the air pump chamber and the exhaust diffusion layer draws air from outside and pumps that air into the air diffusion layer and hence into the shoe.

In some embodiments the resistance of the air pump chamber may be altered by varying the geometry, material and wall thicknesses of the air pump chamber, and there may be no air cushions 304.

Figure 4:
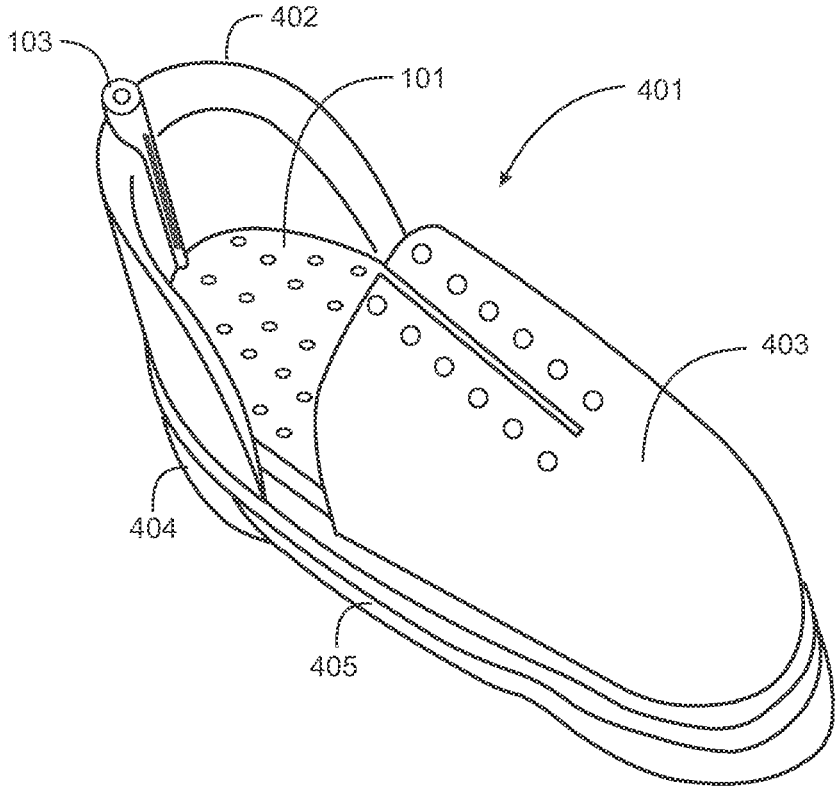
FIG. 4 is a perspective view of an article of footwear comprising a shoe ventilation apparatus in an embodiment of the invention.

FIG. 4 is a perspective, partially cut-away view of a shoe 401 having an apparatus 100 inserted in the shoe. Shoe 401 in this example has a rear capture portion 402 and a forward cover portion 403. Cover portion 403 in this example is split part way by channel 406 which is lined on opposite sides with eyelets 407 for laces (not shown). An air diffusion layer 101 is present, which may be stand-alone or may be adhered to an air pump chamber which is built into the shoe below the air diffusion layer. An air intake channel 103 with a one-way valve is shown within the rear portion 402 and proceeds from the air pump chamber that not seen in this view but is built into the shoe.

It will be apparent to the skilled person that shoe 401 is representative of articles of footwear such as boots or shoes that may have elements of the apparatus 100 of FIG. 1 built in or added as may be added an insole apparatus. It will also be apparent to the skilled person that the embodiments illustrated and described herein are exemplary only, and not limiting to the overall scope of the invention. There are many existing boots and shoes to which apparatus 100 may be applied, and there are many alterations that may be made in embodiments described within the scope of the invention. The invention is limited only by the scope of the claims.

The invention claimed is:

1. A ventilation apparatus of an article of footwear comprising:

a hollow air pump chamber having an outer shape of an inside of the article of footwear, the hollow air pump chamber having a flexible side wall of a constant height around an outer periphery in the outer shape, a flexible top wall, a flexible bottom wall, and a plurality of air cushion elements extending between a surface of the flexible bottom wall and a surface of the felexible top wall inside the hollow air pump chamber, each air cushion element formed from flexible material, having alternating circular horizontal cross sections of a larger diameter and a smaller diameter, and being closed on both ends;

a plurality of one-way air valves positioned through the flexible top wall of the air pump chamber, allowing air flow only out of the air pump chamber; and an air intake channel coupled through an opening into the air pump chamber, the air intake channel having a one-way air valve allowing air to flow only into the air pump chamber;

wherein action of stepping down on the air pump chamber deforms the walls of the air pump chamber in a manner to decrease volume and increase pressure in the air pump chamber, and forces air out of the air pump chamber through the plurality of one-way air valves positioned through the flexible top wall of the air pump chamber, and action of lifting weight off the air pump chamber causes the deformed walls to return toward original form, decreasing pressure in the air pump chamber and drawing air in through the air intake channel.

2. The ventilation apparatus of claim 1 wherein the height is equal or less than one-half inch.

3. The ventilation apparatus of claim 1 further comprising a separate air diffusion layer overlying the air pump chamber, the air diffusion layer comprising open-cell material receiving air from the air pump chamber through the one or more one-way air valves in the top of the air pump chamber.

4. The ventilation apparatus of claim 3 wherein the air diffusion layer has the horizontal shape of the air pump chamber.

5. The ventilation apparatus of claim 3 wherein the air diffusion layer is joined by adhesive to the top of the air pump chamber.

6. An article of footwear, comprising:

a sole portion;

an upper portion adapted to retain a user's foot;

an opening in the upper portion adapted to enable the user to insert the foot; and a ventilation apparatus supported on the sole in the article of footwear, the ventilation apparatus comprising:

a hollow air pump chamber having an outer shape of an inside of the article of footwear, the hollow air pump chamber having a flexible side wall of a constant height around an outer periphery in the outer shape, a flexible top wall, a flexible bottom wall, and a plurality of air cushion elements extending between a surface of the flexible bottom wall and a surface of the felexible top wall inside the hollow air pump chamber, each air cushion element formed from flexible material, having alternating circular horizontal cross sections of a larger diameter and a smaller diameter, and being closed on both ends;

a plurality of one-way air valves positioned through the flexible top wall of the air pump chamber, allowing air flow only out of the air pump chamber; and an air intake channel coupled through an opening into the air pump chamber, the air intake channel having a one-way air valve allowing air to flow only into the air pump chamber;

wherein action of stepping down on the air pump chamber deforms the walls of the air pump chamber in a manner to decrease volume and increase pressure in the air pump chamber, and forces air out of the air pump chamber through the plurality of one-way air valves positioned through the flexible top wall of the air pump chamber, and action of lifting weight off the air pump chamber causes the deformed walls to return toward original form, decreasing pressure in the air pump chamber and drawing air in through the air intake channel.

7. The article of footwear of claim 6 wherein the height of the flexible side wall is equal or less than one-half inch.

8. The article of footwear of claim 6 further comprising a separate air diffusion layer overlying the air pump chamber, the air diffusion layer comprising open-cell material receiving air from the air pump chamber through the plurality of one-way air valves in the top of the air pump chamber.

9. The article of footwear of claim 8 wherein the air diffusion layer has the horizontal shape of the air pump chamber.

10. The article of footwear of claim 6 wherein the air diffusion chamber is joined by adhesive to the top of the air pump chamber.

11. The article of footwear of claim 6 wherein the ventilation apparatus is separate from the article of footware and insertable into and removable from the article of footwear.

12. The article of footwear of claim 6 wherein the ventilation apparatus is built into the article of footwear.

13. A method for ventilating an article of footwear, comprising:

implementing a ventilation apparatus comprising a hollow air pump chamber having an outer shape of an inside of the article of footwear, the hollow air pump chamber having a flexible side wall of a constant height around an outer periphery in the outer shape, a flexible top wall, a flexible bottom wall, and a plurality of air cushion elements extending between a surface of the flexible bottom wall and a surface of the felexible top wall inside the hollow air pump chamber, each air cushion element formed from flexible material, having alternating circular horizontal cross sections of a larger diameter and a smaller diameter, and being closed on both ends in the article of footwear;

stepping down on the hollow air pump chamber having a flexible top, bottom and side walls in the article of footwear, deforming the walls of the air pump chamber in a manner to decrease volume and increase pressure in the air pump chamber, forcing air out of the air pump chamber through a plurality of one-way air valves positioned through the top wall of the air pump chamber; and lifting weight off the air pump chamber causing the deformed walls to return toward original form, decreasing pressure in the air pump chamber and drawing air in through an air intake channel having a one-way air valve allowing air only into the air pump chamber.

14. The method of claim 13 wherein the height is equal or less than one-half inch, and the act of stepping down is done over a height of less than one-half inch.

15. The method of claim 13 further comprising a seaparate air diffusion layer overlying the air pump chamber, the air diffusion layer comprising open-cell material and receiving air from the air pump chamber through the one or more one-way air valves in the top of the air pump chamber, comprising pumping air into the air diffusion layer.

16. The method of claim 15 wherein the air diffusion layer has the horizontal shape of the air pump chamber, comprising pumping air into the air diffusion layer.

17. The method of claim 13 wherein the air diffusion chamber is joined by adhesive to the top of the air pump chamber, comprising pumping air into the air diffusion layer.

* * * * *